US011523964B2

(12) United States Patent
Dickinson

(10) Patent No.: US 11,523,964 B2
(45) Date of Patent: Dec. 13, 2022

(54) SEXUAL STIMULATION DEVICE

(71) Applicant: Daniel James Dickinson, Lincolnshire, IL (US)

(72) Inventor: Daniel James Dickinson, Lincolnshire, IL (US)

( * ) Notice: Subject to any disclaimer, the term of this patent is extended or adjusted under 35 U.S.C. 154(b) by 6 days.

(21) Appl. No.: 17/175,778

(22) Filed: Feb. 15, 2021

(65) Prior Publication Data

US 2022/0257457 A1 Aug. 18, 2022

(51) Int. Cl.
*A61H 19/00* (2006.01)

(52) U.S. Cl.
CPC ..... *A61H 19/34* (2013.01); *A61H 19/40* (2013.01); *A61H 2201/1692* (2013.01)

(58) Field of Classification Search
CPC ..... A61H 19/34; A61H 19/44; A61H 19/40
USPC ..... 600/38
See application file for complete search history.

(56) References Cited

U.S. PATENT DOCUMENTS 4,722,327 A * 2/1988 Harvey ..... A61H 19/44 104/53
5,076,261 A 12/1991 Black
5,676,637 A 10/1997 Lee
6,142,929 A * 11/2000 Padgett ..... A61H 23/0254 600/38
6,422,993 B1 7/2002 Hudson
6,866,645 B2 3/2005 Lee
2005/0113636 A1 5/2005 Tucker
2007/0299378 A1* 12/2007 Nan ..... A61H 19/44 601/98
2008/0071138 A1* 3/2008 Mertens ..... A61H 19/34 600/38
2015/0148592 A1* 5/2015 Kanbar ..... A61H 19/34 600/38
2015/0351998 A1 12/2015 Levy
(Continued)

FOREIGN PATENT DOCUMENTS

GB 2492535 A * 1/2013

OTHER PUBLICATIONS

DocJohnson ("iRide" https://web.archive.org/web/20201111223820/https://www.docjohnson.com/iride-dual-bullets.html; available online on Nov. 11, 2020; accessed online on Apr. 13, 2022) (Year: 2020).*
(Continued)

*Primary Examiner* — Kaylee R Wilson
(74) *Attorney, Agent, or Firm* — Hunter E. Webb; Keohane & D'Alessandro, PLLC

(57) ABSTRACT

Disclosed embodiments provide an improved stimulation device for sexual gratification. An enclosure includes a moveable shaft in a phallic shape, and a vibration surface located near the base of the shaft. The arrangement allows the shaft to be inserted in the vagina of a user while the vibration surface is in contact with the clitoral region of the user. In embodiments, the enclosure comprises two concave sides and a convex opposing surface. The concave side surfaces are well suited to accommodate the legs of a user. The convex opposing surface enables a rocker mode of operation in which the user places the device on a floor surface such that the convex opposing surface is on the floor, and then straddles the device, enabling a rocking motion during stimulation, which can create an enhanced user experience.

19 Claims, 19 Drawing Sheets

(56) References Cited

U.S. PATENT DOCUMENTS

| | | | | |
|---|---|---|---|---|
| 2016/0045392 | A1* | 2/2016 | Massey | A61H 7/003 601/46 |
| 2019/0015292 | A1* | 1/2019 | Pounders | A61H 19/00 |
| 2020/0330320 | A1 | 10/2020 | Shahoian et al. | |

OTHER PUBLICATIONS

Amazon, "Doc Johnson Iride—Ridable Dual Zone Vibrator", https://www.amazon.com/Doc-Johnson-Iride-Clittoral-Stimulating/dp/B004HJLZO0, Sep. 18, 2006, 4 pgs.

Amazon, "Threesome Rock n' Grind Silicone Vibrator", https://www.amazon.com/Threesome-Rock-Grind-Silicone-Vibrator/dp/B084C5QNGJ, Jan. 30, 2020, 5 pgs.

Rodriquez, Kari, PCT Notification of Transmittal of the International Search Report and the Written Opinion of the International Searching Authority, PCTUS22/16439, dated May 3, 2022, 8 pgs.

* cited by examiner

SEXUAL STIMULATION DEVICE

FIELD

Disclosed embodiments relate generally to sexual stimulation devices.

BACKGROUND

There are numerous devices available for use by women for sexual stimulation. They include products that are manually operated, and achieve stimulation by shape and/or texture, as well as devices that are provided with internal motors that achieve stimulation by shape, texture and vibration. These latter devices, commonly referred to as vibrators, can be phallus shaped, and may include a handle for manipulation in and around the genital region by a woman. In general, there are at least three distinct effective genital stimulation areas in most women, namely the clitoris and surrounding skin, the inner surface of the vagina and the so-called G-spot, a nerve reflex area inside the vagina, along the anterior surface. Sexual stimulation devices can be used to promote a healthy sex life and increase sexual pleasure. It is therefore desirable to have improvements in sexual stimulation devices.

SUMMARY

In one embodiment, there is provided a sexual stimulation device, comprising: an enclosure; wherein the enclosure comprises: a shaft-side surface; a first concave side surface; a second concave side surface; and a shaft protruding from the shaft-side surface of the enclosure.

In another embodiment, there is provided a sexual stimulation device, comprising: an enclosure; wherein the enclosure comprises: a shaft-side surface; a first concave side surface; a second concave side surface; a shaft protruding from the shaft-side surface of the enclosure; a shaft motor disposed in an interior of the enclosure; a barrel cam mechanically coupled to the shaft motor; and wherein the shaft is mechanically coupled to the barrel cam.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Figure 1:
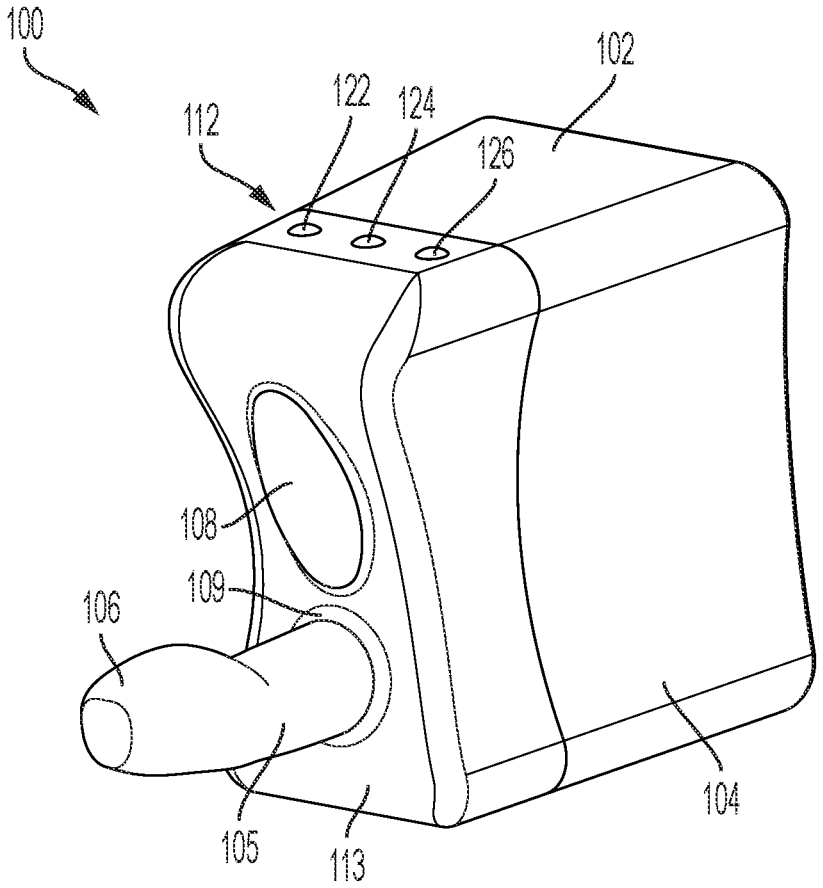
FIG. 1 shows a perspective view of an embodiment of the present invention.

Disclosed embodiments provide an improved stimulation device for sexual gratification. An enclosure includes a shaft in a phallic shape having a moveable tip, and a clitoral massage surface located near the base of the shaft. The arrangement allows the shaft to be inserted in the vagina of a user while the clitoral massage surface is in contact with the clitoral region of the user. In embodiments, the enclosure comprises two concave sides and a convex opposing surface. In some embodiments, the massage surface vibrates as described herein. Note that the vibration can be substituted with pulsation, gyration, or other massage pattern within the scope of the invention. The concave side surfaces are well suited to accommodate the legs of a user. The convex opposing surface enables a rocker mode of operation in which the user places the device on a floor surface such that the convex opposing surface is on the floor, and then straddles the device, enabling a rocking motion during stimulation, which can create an enhanced user experience. In some embodiments, the sides may not be concave. In some embodiments, the sides may be straight, convex, or other suitable shape.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements. For the purposes of disclosure, the word, "substantially" is defined as "for the most part". It means "to a great extent," but having some room for some minor variation.

FIG. 1 shows a perspective view of an embodiment of the present invention. Device 100 includes an enclosure 102. The enclosure 102 has a side surface 104. In embodiments, side surface 104 has a concave shape that is well-suited to conform to the convex shape of the leg of a user. Device 100 further comprises a clitoral massage surface 108 and a shaft 105. The shaft 105 protrudes from a shaft-side surface 113 of enclosure 102. The shaft 105 has tip region 106 on a distal end of the shaft 105. In embodiments, the vibration surface 108 is disposed on the enclosure 102 between 3 centimeters to 6 centimeters above the shaft attachment point 109. In this way, when the shaft 105 is inserted into the vagina of a user, the clitoral massage surface 108 is disposed on the clitoris region of the user. In embodiments, the tip region 106 has a larger diameter than the diameter of the shaft 105. In some embodiments, the clitoral massage surface 108 is a vibration surface. In some embodiments, instead of vibration, there is pulsation, gyration or other suitable massage pattern or mechanism. In embodiments, the shaft 105 includes a silicone exterior surface.

The enclosure may further include a user interface 112. In embodiments the user interface may include one or more buttons, indicated as 122, 124, and 126. In embodiments, button 122 is an on/off button for the device 100. In embodiments, button 124 is a start/stop button for the clitoral massage surface 108. In embodiments, button 126 is a start/stop button for the tip motion function that controls movement of tip region 106 with respect to shaft 105. The tip motion can be used to stimulate the G-spot of a user during operation of the device 100.

Figure 2:
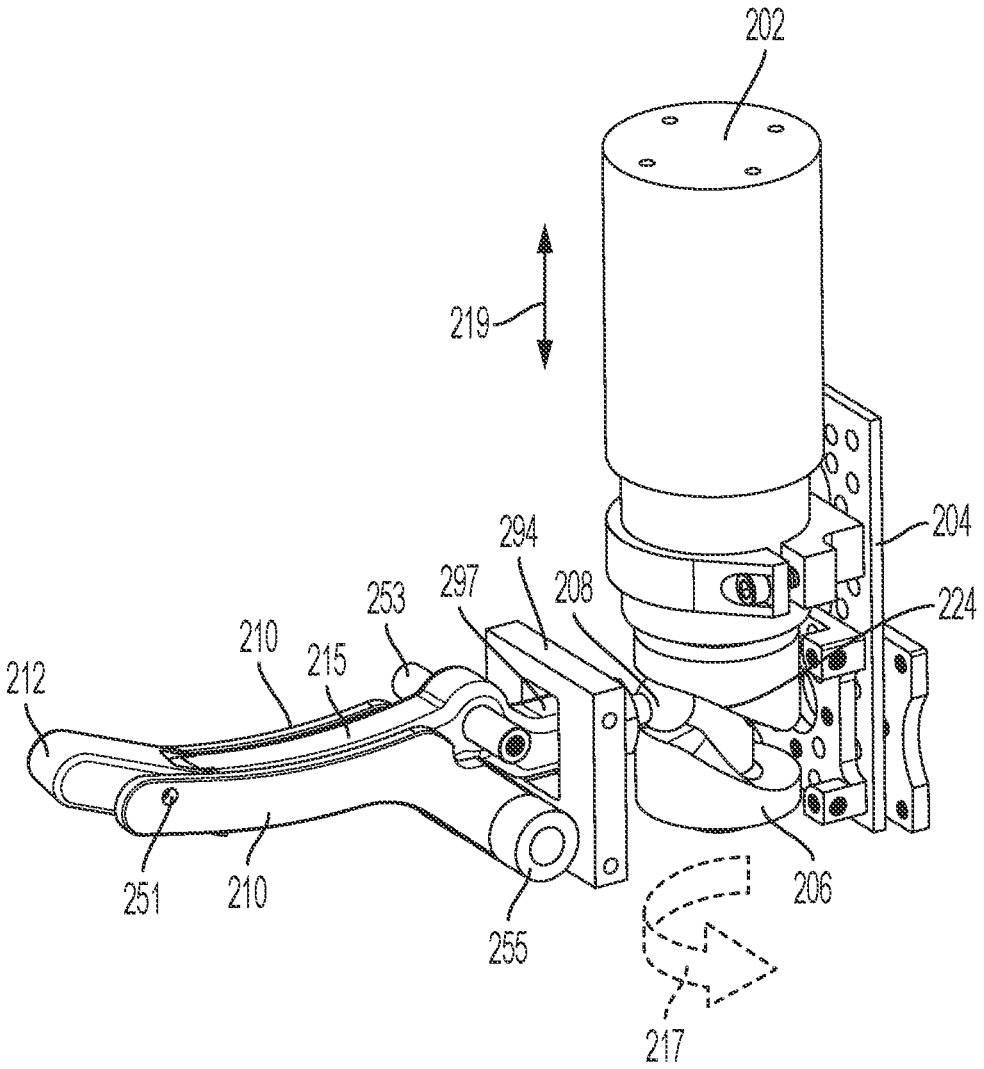
FIG. 2 shows a perspective view of internal components of an embodiment of the present invention.

FIG. 2 shows a perspective view of internal components of an embodiment of the present invention. Internal components shown in FIG. 2 are disposed within an interior of the enclosure 102, and serve to operate the tip deflection motion function of disclosed embodiments. Shaft motor 202 is affixed to chassis portion 204. The shaft motor 202 rotates in the direction indicated by arrow 217. In some embodiments, the motor may rotate in the opposite direction, and/or alternate between the two directions. In some embodiments, the shaft motor 202 may be a 12 Volt DC planetary gearmotor. The shaft motor 202 is coupled to a barrel cam 206. Barrel cam 206 comprises groove 224 that varies in position along the circumference of the barrel cam 206.

Pivot beam 215 includes a pin 208 that is mechanically engaged with the groove 224 of the barrel cam 206. As the barrel cam 206 rotates, the pin 208 is moved in a vertical direction as indicated by arrow 219. This causes pivot beam 215 to move about bushing 253 which serves as a pivot point. The pivot beam 215 traverses an opening 297 within chassis portion 294. Pivot beam 215 is also rotatably attached to side brackets 210. Side brackets 210 rotate about bushings 255 which serve as pivot points. As the pivot beam 215 moves, the side brackets 210 cause the deflection of tip 212, which is rotatably attached to the side brackets at pivot point 251. The tip is also rotatably attached to the pivot beam 215.

Figure 3A:
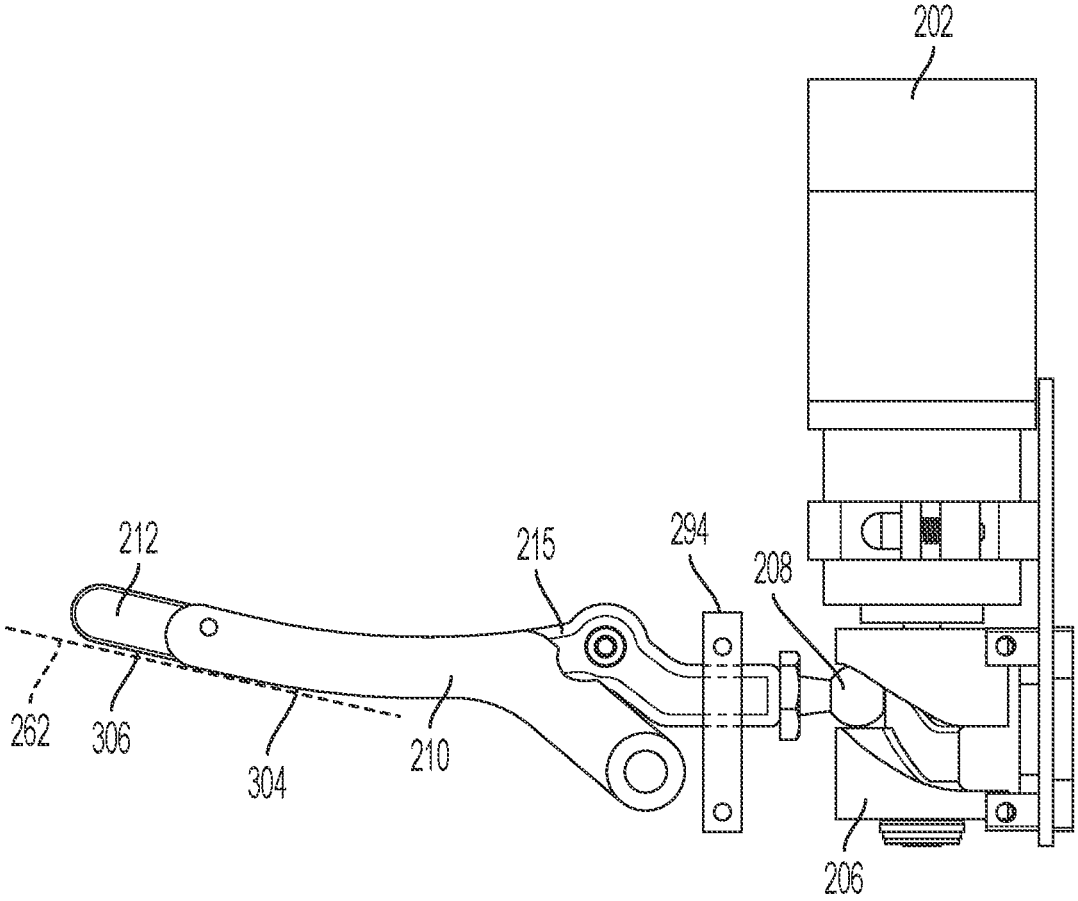
FIG. 3A is a side view of internal components in a lowered position.
Figure 3B:
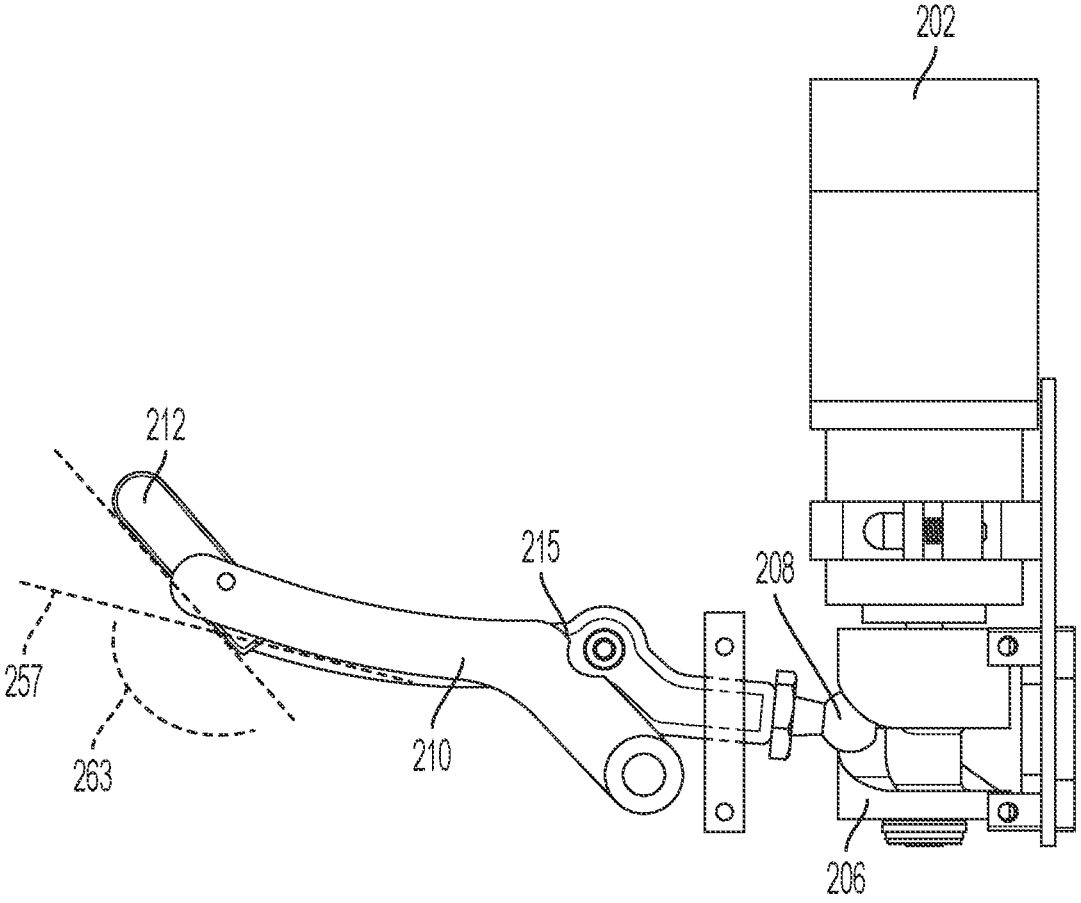
FIG. 3B is a side view of internal components in an intermediate position.
Figure 3C:
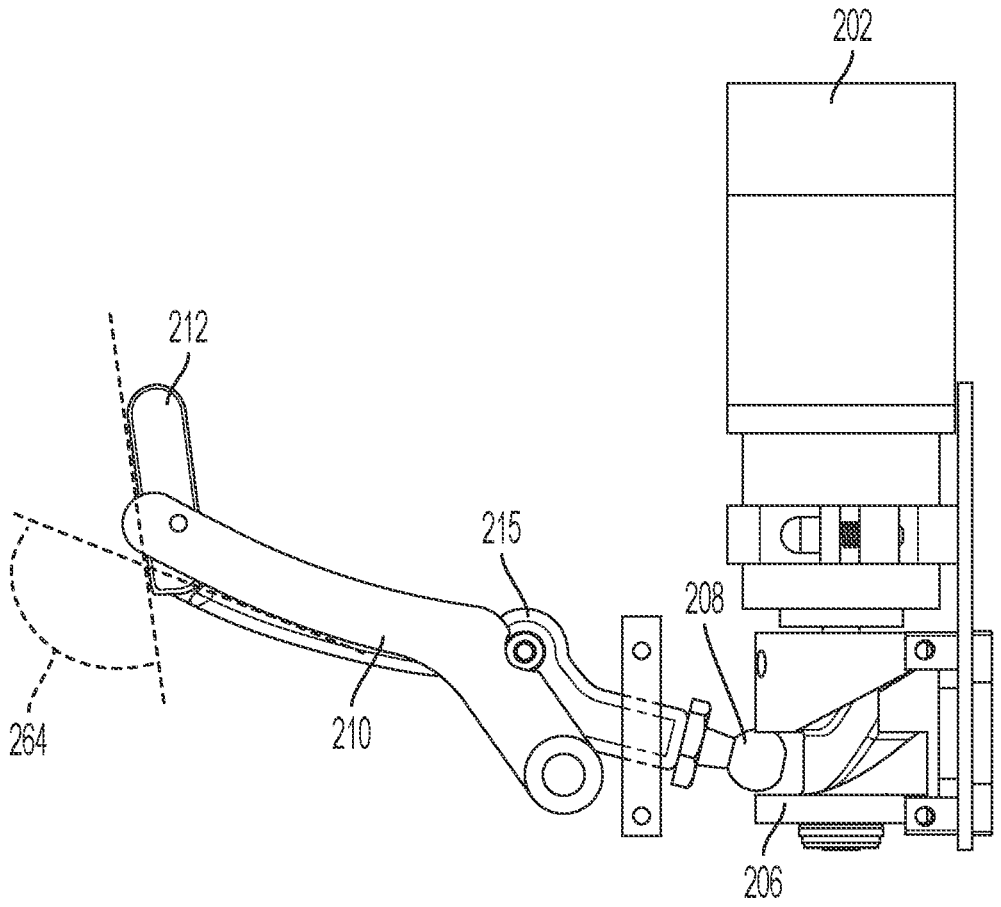
FIG. 3C is a side view of internal components in a raised position.

FIGS. 3A-3C show operation of the moveable tip 212. FIG. 3A is a side view of internal components in a lowered position. Tangent line 262 is shown in contact with the tip 212 and an adjacent region of the lower edge 304 of side bracket 210. In this view, the lower edge 306 of tip 212 is parallel to tangent line 262. FIG. 3B is a side view of internal components in an intermediate position. As shown in FIG. 3B. the barrel cam 206 as rotated from the position shown in FIG. 3A, such that pin 208 shown in FIG. 3B is lower than shown in FIG. 3A. This causes pivot beam 215 to elevate, which causes side brackets 210 to elevate, causing tip 212 to deflect at angle 263 with respect to the side brackets 210. Line 257 represents a longitudinal axis of the pivot beam. As can be seen in FIG. 3B, the tip 212 can deflect with respect to a longitudinal axis of the pivot beam at an angle 263.

FIG. 3C is a side view of internal components in a fully raised position. In this view, the barrel cam 206 is rotated from the position shown in FIG. 3A, such that pin 208 shown in FIG. 3C is at its lowest point, causing tip 212 to deflect at an angle 264, where angle 264 is an angle of maximum deflection. In embodiments, angle 264 ranges from 95 degrees to 125 degrees.

Figure 4B:
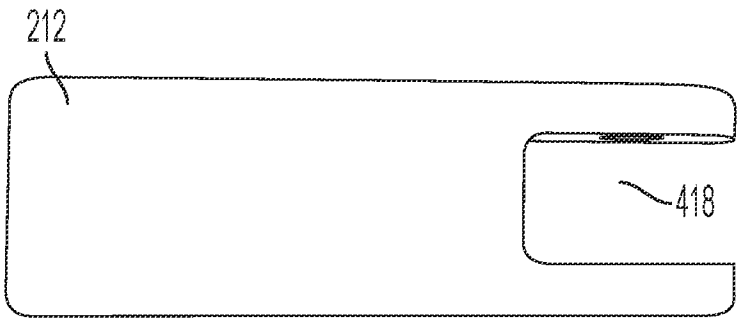
FIG. 4B is a top-down view of a tip.
Figure 4C:
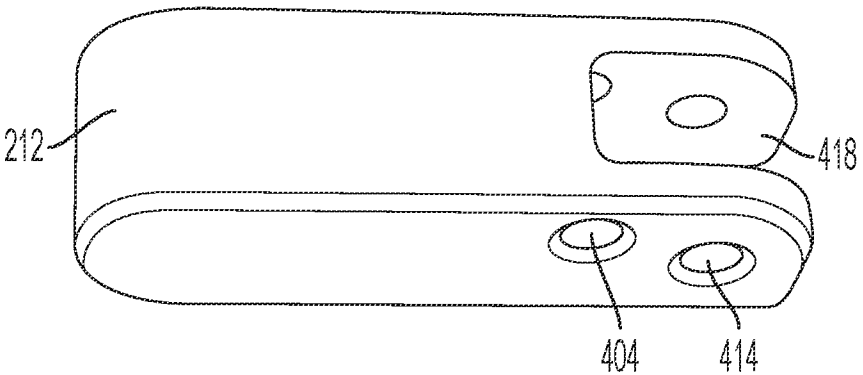
FIG. 4C is a perspective view of a tip.
Figure 4A:
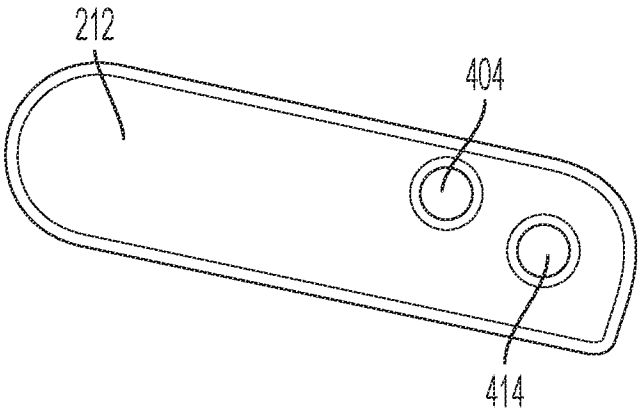
FIG. 4A is a side view of a tip.

FIG. 4A is a side view of a tip 212. FIG. 4B is a top-down view of tip 212. FIG. 4C is a perspective view of tip 212. Tip 212 comprises a first opening 404 and a second opening 414. First opening 404 is used for rotatably attaching the tip 212 to the pivot beam 215. Second opening 414 is used for rotatably attaching the tip 212 to the side brackets 210. Tip 212 comprises notch 418 for engaging with the pivot beam 215.

Figure 5A:
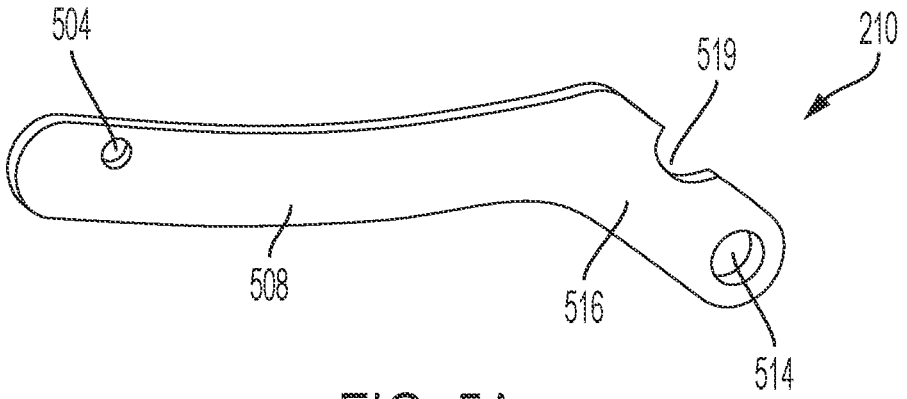
FIG. 5A is a perspective view of a side bracket.
Figure 5B:
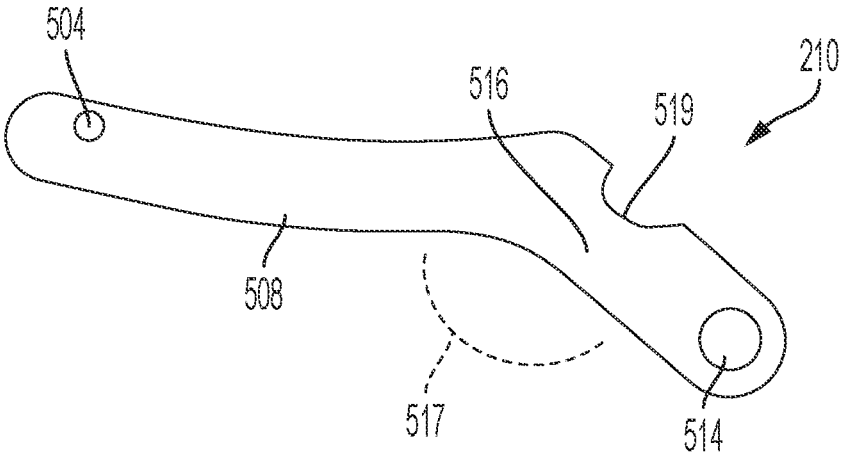
FIG. 5B is a side view of a side bracket.

FIG. 5A is a perspective view of a side bracket 210. FIG. 5B is a side view of a side bracket 210. Side bracket 210 comprises first portion 516 and second portion 508. In embodiments, the first portion 516 and second portion 508 are joined at an angle 517. In embodiments, angle 517 ranges from 100 degrees to 160 degrees. A first opening 514 is used to rotatably attach the side bracket 210 to the chassis. A second opening 504 is used to rotatably attach the side bracket 210 to the tip 212. First portion 516 comprises concave cutout 519 formed therein. In embodiments, concave cutout 519 periodically contacts a bushing during operation as the side bracket 210 moves.

Figure 6A:
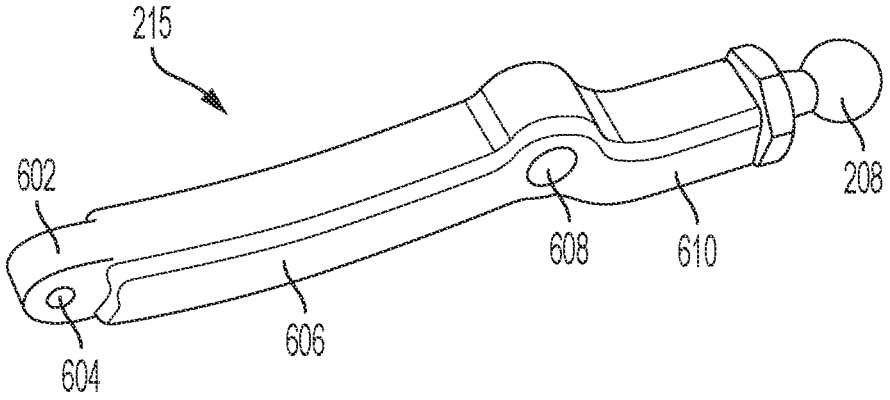
FIG. 6A is a perspective view of a pivot beam.
Figure 6B:
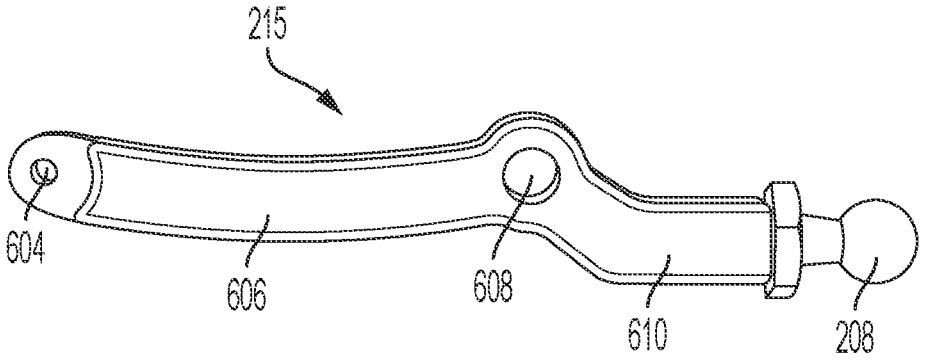
FIG. 6B is a side view of a pivot beam.

FIG. 6A is a perspective view of pivot beam 215. FIG. 6B is a side view of a pivot beam 215. Pivot beam 215 includes a pin 208 affixed to a first section 610. The first section 610 is joined to a second section 606 with an opening 608 formed therein between the first section 610 and second section 606. The opening 608 is used to rotatably attach the pivot beam 215 to the chassis of the device. An additional opening 604 is formed at distal end 602 of the pivot beam 215. The opening 604 is used to rotatably attach the pivot beam 215 to the tip 212. The distal end 602 is narrower than the second section 606 so that the distal end can fit within notch 418 of the tip 212.

Figure 7:
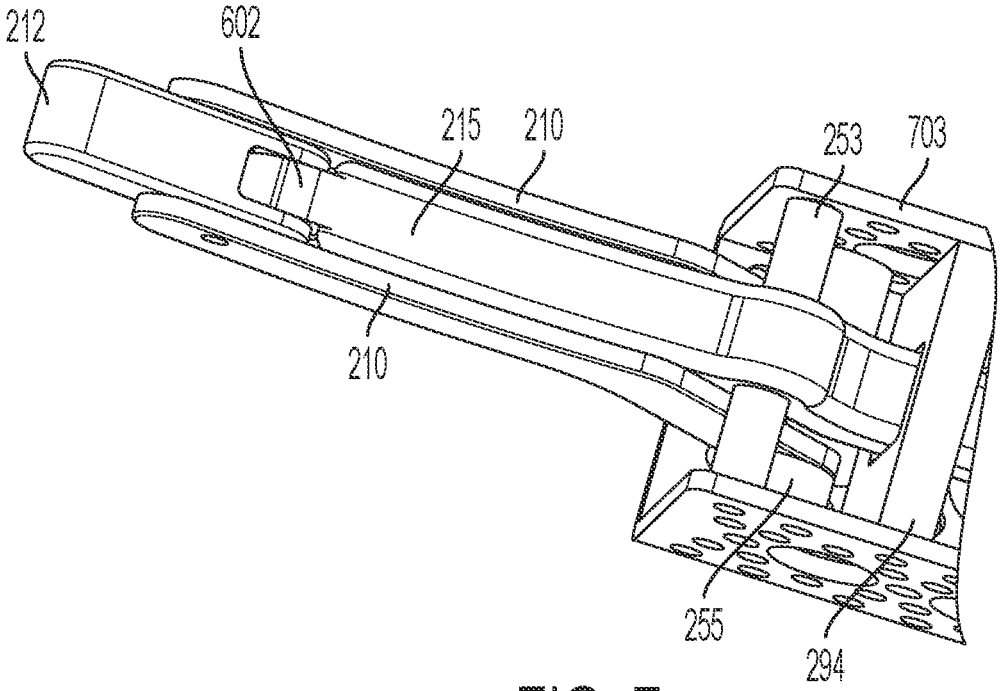
FIG. 7 is a perspective view of the pivot beam in an assembly.

FIG. 7 is a perspective view of the pivot beam in an assembly. As can be seen in FIG. 7, a side bracket 210 is installed on two sides of the pivot beam 215. The distal end 602 of the pivot beam 215 engages with the tip 212. The pivot beam is rotatably affixed to the chassis section 703 via bushing 253, which traverses opening 608 of the pivot beam. In this view, it can be seen that the assembly includes two side brackets 210. The side brackets 210 are rotatably affixed to the chassis section 703 via bushings 255.

Figure 8:
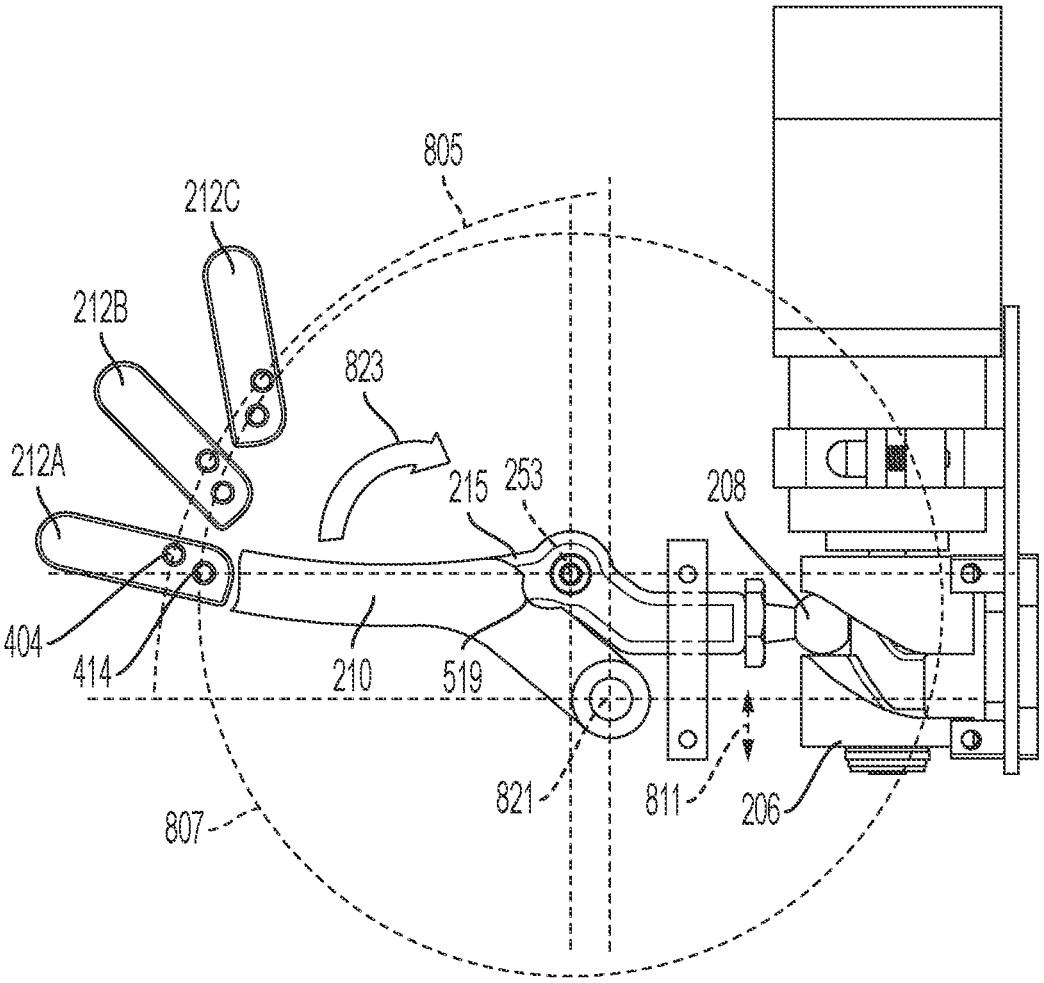
FIG. 8 is an illustration indicating arcs of motion for an assembly.

FIG. 8 is an illustration indicating arcs of motion for an assembly. As shown in FIG. 8, first arc 807 is off-center with respect to arc 805. Arc 807 includes a travel path for pivot beam 215. Arc 805 includes a travel path for side bracket 210. During operation, the barrel cam 206 rotates, causing pin 208 to move up and down in the direction indicated by arrow 811. Pivot beam 215 rotates about bushing 253, also causing side bracket 210 to rotate about point 821. As side bracket rotates, the two openings 404 and 414 of the tip cause the orientation of the tip to change as the pivot beam 215 rotates. As can be seen, arc 805 and arc 807 get closer together as the pivot beam 215 rotates in the direction of arrow 823. This forces the tip to change orientation as indicated by the sequence of tip motion indicated by 212A, 212B, and 212C. The motion of this tip can enable G-spot stimulation of a user during use. The moveable tip is rotatably attached to both the pivot beam 215, and the two side brackets 210, enabling the operation shown in FIGS. 3A-3C and also in FIG. 8. The tip, side brackets and pivot beam are disposed within a soft silicone sheath as an exterior surface (as shown in FIG. 1), to provide comfort and stimulation for a user. In embodiments, the silicone sheath shown in FIG. 1 may be removable to allow for its cleaning.

In embodiments, the pivot beam has a first point of rotation shown as 253, the first side bracket and second side bracket have a second point of rotation shown as 821, and the first point of rotation is different than the second point of rotation.

Figure 9:
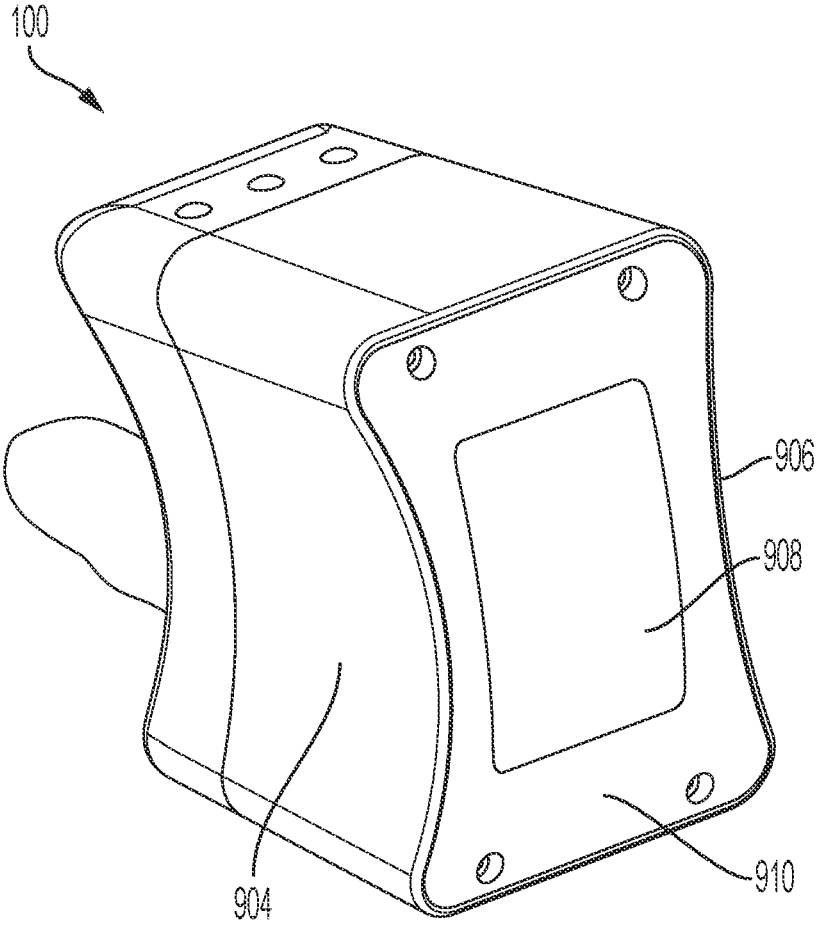
FIG. 9 shows a rear-perspective view of an embodiment of the present invention.

FIG. 9 shows a rear-perspective view of an embodiment of the present invention. As can be seen in FIG. 9, device 100 comprises a concave side 904 that is adapted to contact the leg of a user during use. A similar concave profile exists on opposite side 906. Concave surfaces are sized to fit a side of a human leg comfortably thereagainst. The opposing surface 910 is disposed opposite the shaft-side surface 113 and may be convex, and, in some embodiments, may also include a battery compartment 908 that contains a removeable battery. In this way, a battery for the device can be removed and replaced and/or charged, while the device 100 can be discretely stored out of sight.

Figure 10:
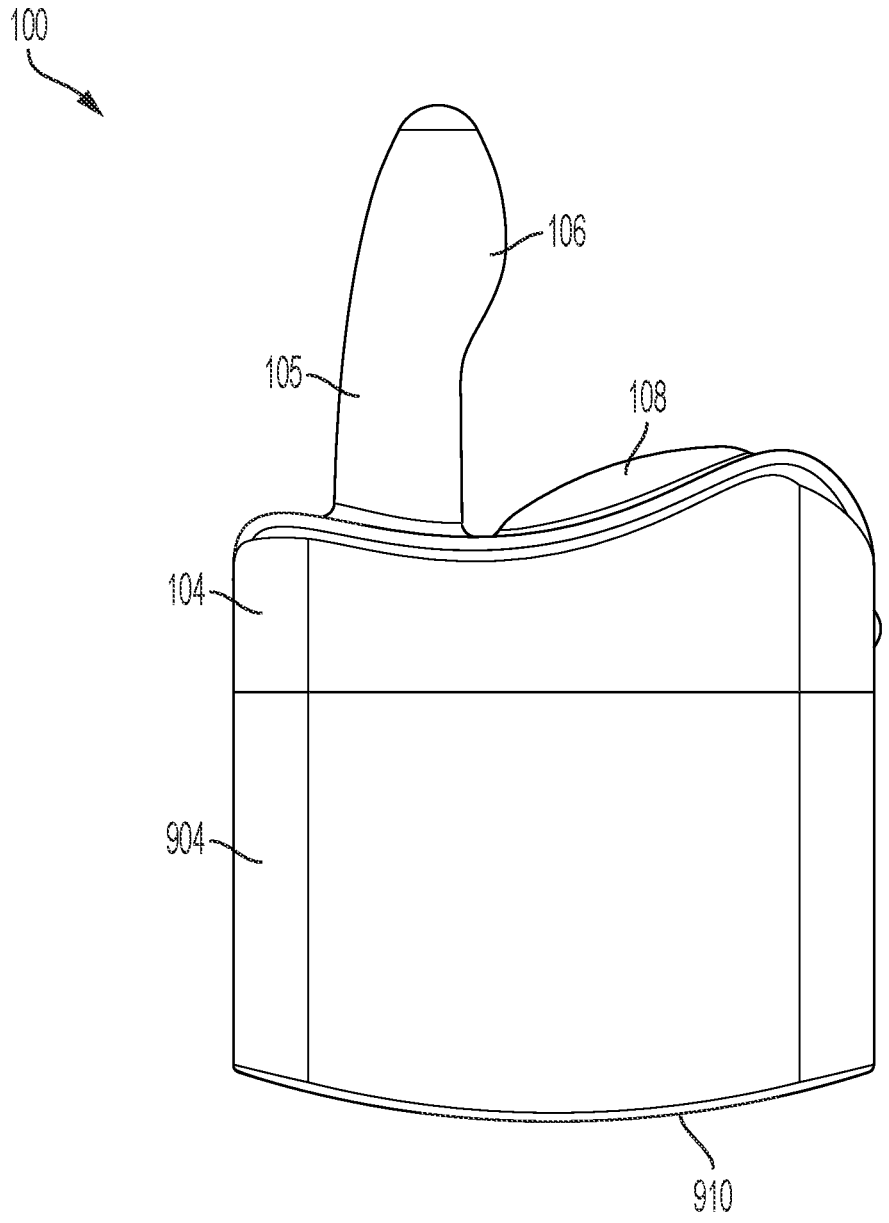
FIG. 10 shows a side view of an embodiment of the present invention.

FIG. 10 shows a side view of an embodiment of the present invention. As can be seen in FIG. 10, in some embodiments, the device 100 has convex opposing surface 910. The convex opposing surface enables a "rocker" mode of operation. In the rocker mode of operation, the user places the device 100 on a floor surface, and then straddles the device to receive stimulation. The convex opposing surface 910 allows the user to rock back and forth while the tip of the shaft 105 moves as illustrated in FIG. 8 to provide G-spot stimulation. Additionally, or alternatively, the clitoral massage surface 108 can be activated to provide clitoral stimulation.

Figure 11:
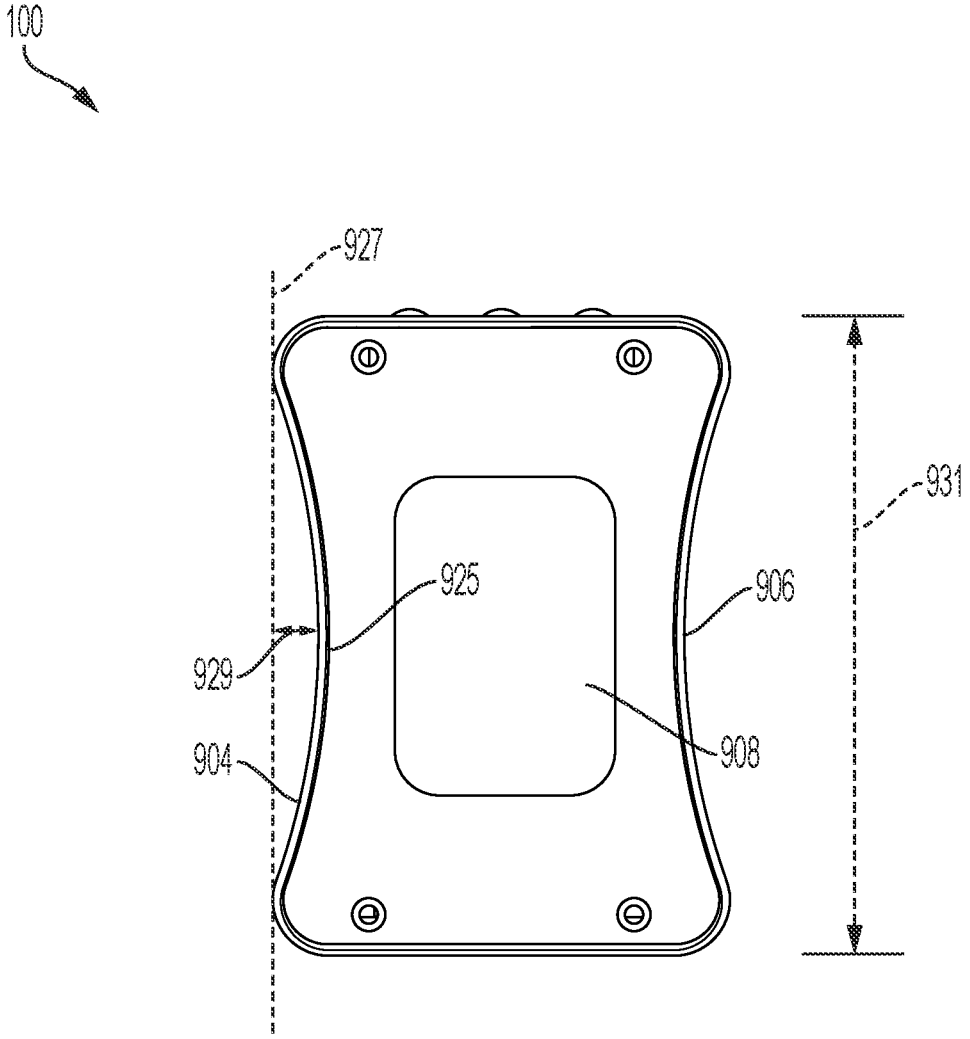
FIG. 11 shows a rear view of an embodiment of the present invention.

FIG. 11 shows a rear view of an embodiment of the present invention. As can be seen in FIG. 11, the sides 904 and 906 have a concave shape that is well-suited to engage with legs of a user during use. The battery compartment 908 contains a removable battery that can be replaced or recharged outside of the device 100. In some embodiments, the battery is rechargeable while inside the device, and removal is not generally necessary.

As can be seen in FIG. 11, the device 100 has a height 931. In embodiments, the height 931 ranges from 15 centimeters to 25 centimeters. The concavity of the sides 904 and 906 is such that there is a distance 929 between the inflection point 925 and the outer extent 927 of the side 904. In embodiments, the distance 929 ranges from two centimeters to five centimeters. These dimensions provide a gradual curve that can comfortably accommodate the leg sizes of most users.

Figure 12:
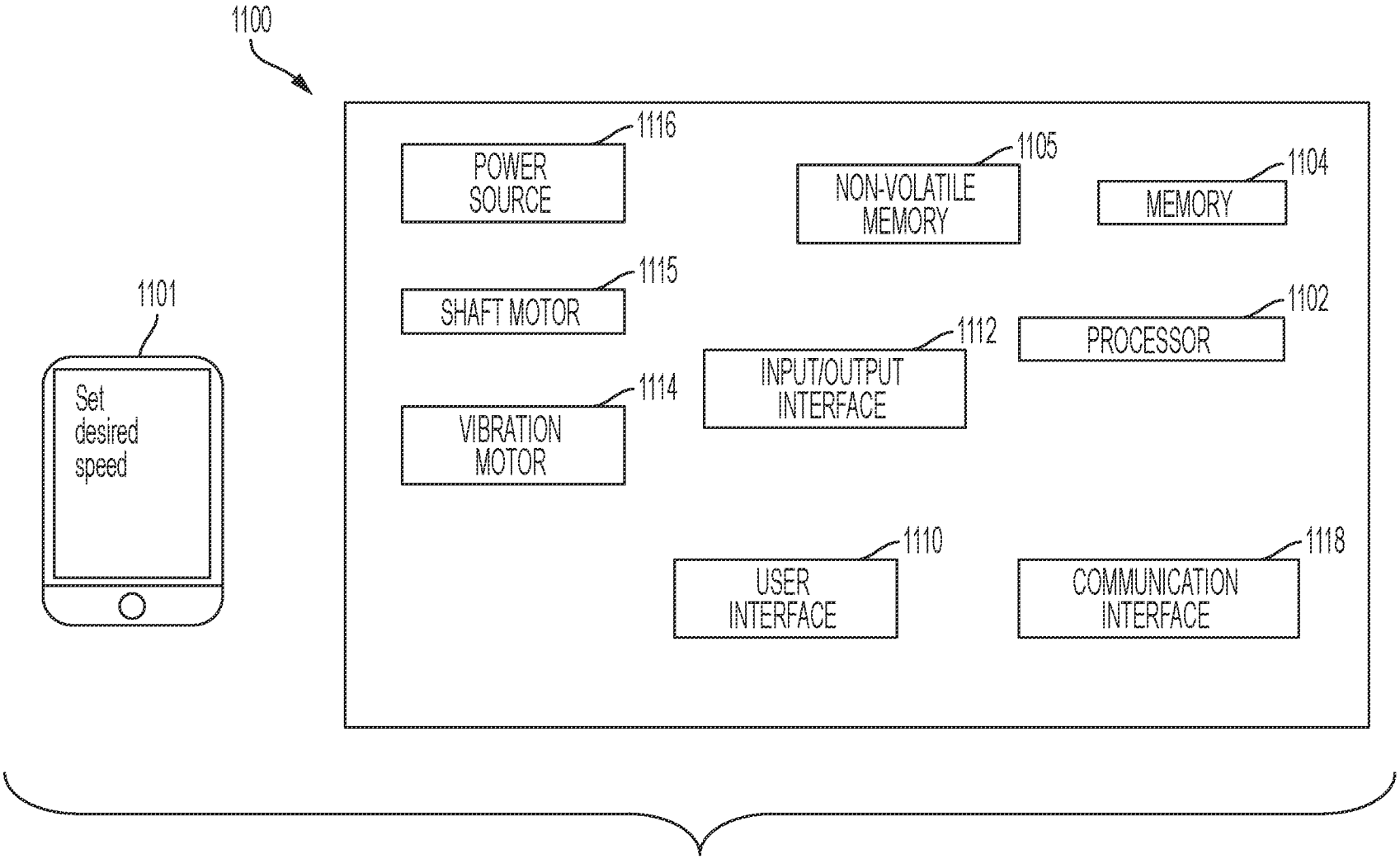
FIG. 12 is a block diagram indicating components in accordance with embodiments of the present invention.

FIG. 12 is a block diagram of an embodiment of a stimulation device 1100 in accordance with disclosed embodiments. The stimulation device includes a processor 1102 and memory 1104. Memory 1104 may be a computer-readable medium such as flash, battery-backed static RAM, or other suitable computer-readable medium. In some embodiments, the memory may be non-transitory. The memory 1104 contains instructions, that when executed by the processor 1102, perform steps in accordance with embodiments of the present invention. For example, in some embodiments, the memory contains instructions, that when executed by the processor, control the operation of the G-spot stimulation function and/or clitoral stimulation vibration function.

The stimulation device may include an onboard input/output interface 1112. This may include one or more input, output, and/or bidirectional pins for control of the stimulation device. User interface 1110 may include one or more buttons (e.g., buttons 122, 124, and 126 of FIG. 1), switches, knobs, or other suitable controls disposed on the stimulation device. The buttons may be configured to create a signal on one or more input pins of the I/O interface 1112. The processor may utilize interrupt service routines or monitoring loops to detect button presses and change the operation of the shaft motor 1115 and/or vibration motor 1114 accordingly. Shaft motor 1115 may be similar to shaft motor 202.

In some embodiments, the processor 1102 controls the speed of the vibration motor 1114 and/or shaft motor 1115. Accordingly, a user may choose a speed appropriate for her comfort level. The higher the speed, generally, the more intense the stimulation. The stimulation device may include non-volatile memory 1105 for storing user settings such as a preferred speed setting and/or mode of operation.

In some embodiments, instead of or in addition to an onboard user interface 1110, the stimulation device may include a wireless communication interface 1118. The wireless communication interface 1118 may include a Bluetooth®, Wi-Fi, or other suitable interface. The wireless communication interface allows pairing with an electronic device 1101 such as a dedicated remote controller, smartphone, tablet computer, or other electronic device.

In some embodiments, the electronic device enables a rich user interface display, allowing for more complex programming options. Wireless communication interface 1118 may be in communication with a transceiver in the electronic device 1101. The stimulation device may be controlled by the user via an application on the smartphone or computer. Some embodiments may not have all of the aforementioned components. The stimulation device further includes a power source 1116. In embodiments, the power source 1116 can include a battery. The battery can be a replaceable, or internally sealed rechargeable battery. In some embodiments, battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g., 12V DC).

In some embodiments, the electronic device 1101 may provide a speech control function, in which a user can control the stimulation device 1100. In these embodiments, a user may utter a control word such as "faster" or "slower." Upon detecting a control word, the electronic device 1101 may issue a command (e.g., via wireless communication protocol such as Bluetooth®) which is received by processor 1102. Processor 1102, in response to receiving the control word, alters the operational speed of the shaft motor 1115 and/or vibration motor 1114 accordingly. In this way, hands-free adjustment of the device 1100 is possible.

Figure 13:
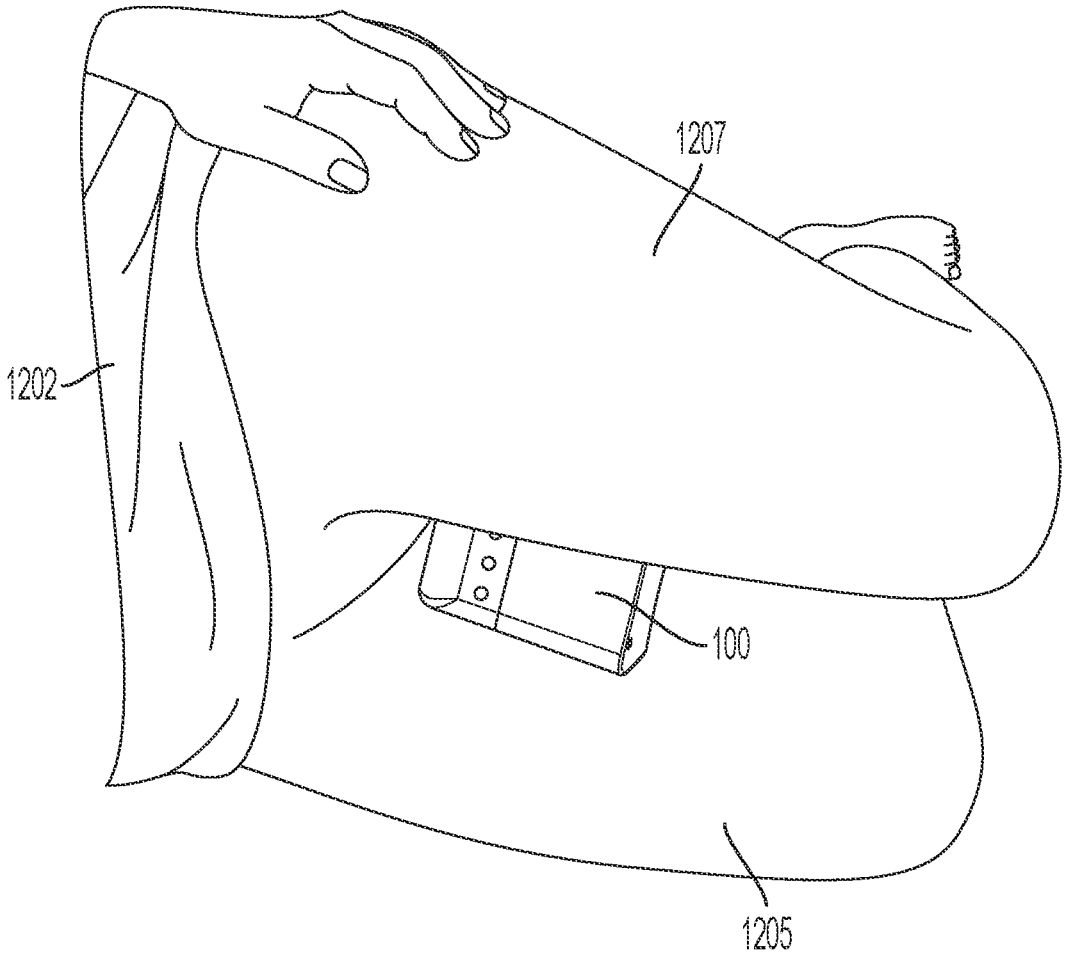
FIG. 13 illustrates usage of a disclosed embodiment in a side position.

FIG. 13 illustrates usage of a disclosed embodiment in a side position. As can be seen in FIG. 13, a user 1202 has positioned a device 100 in accordance with disclosed embodiments in between her left leg 1207 and her right leg 1205. The concave side surfaces (904 and 906) make the use of the device 100 comfortable as they engage with the generally convex shape of the legs. The device 100 can be used in a hands-free manner, as the legs 1205 and 1207 secure the device 100 in place during use.

Figure 14:
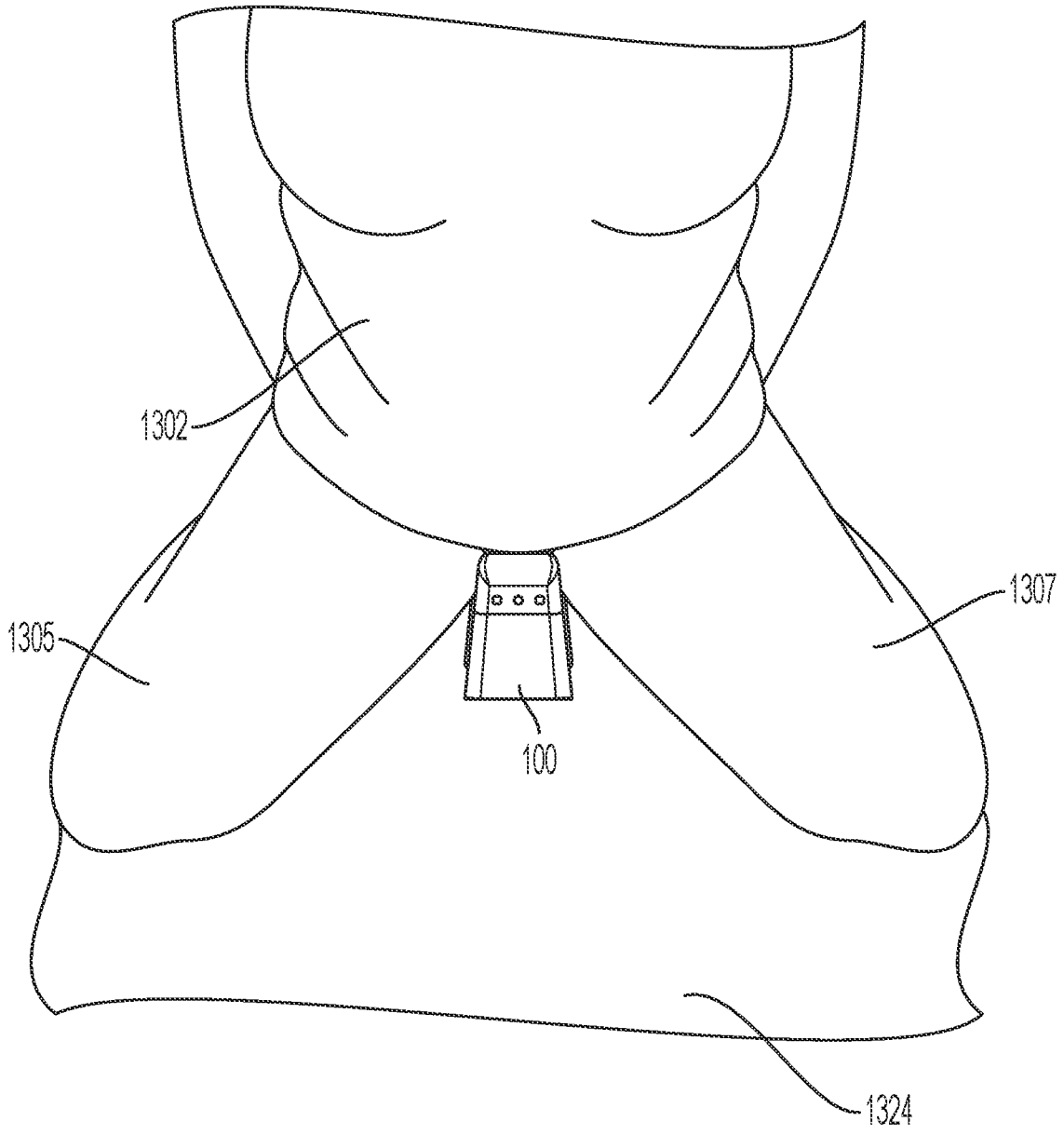
FIG. 14 illustrates usage of a disclosed embodiment in a rocker mode of operation.

FIG. 14 illustrates usage of a disclosed embodiment in a rocker mode of operation. As can be seen in FIG. 14, a user 1302 is straddling device 100, with her left leg 1307 on one side of the device 100, and her right leg 1305 on the other side of the device 100. The device 100 is placed on floor surface 1324 such that the convex opposing surface 910 is in contact with floor surface 1324. In the rocker mode of operation, the user 1302 can move back and forth with the convex opposing surface 910 moving relative to the floor surface 1324, to create a "rocking" sensation during use.

As can be seen in FIG. 13 and FIG. 14, disclosed embodiments can be used in a hands-free manner. Embodiments have a smooth opposing surface (910 of FIG. 9) that enables use in a rocker mode, where the hands do not contact the apparatus during use.

Figure 15:
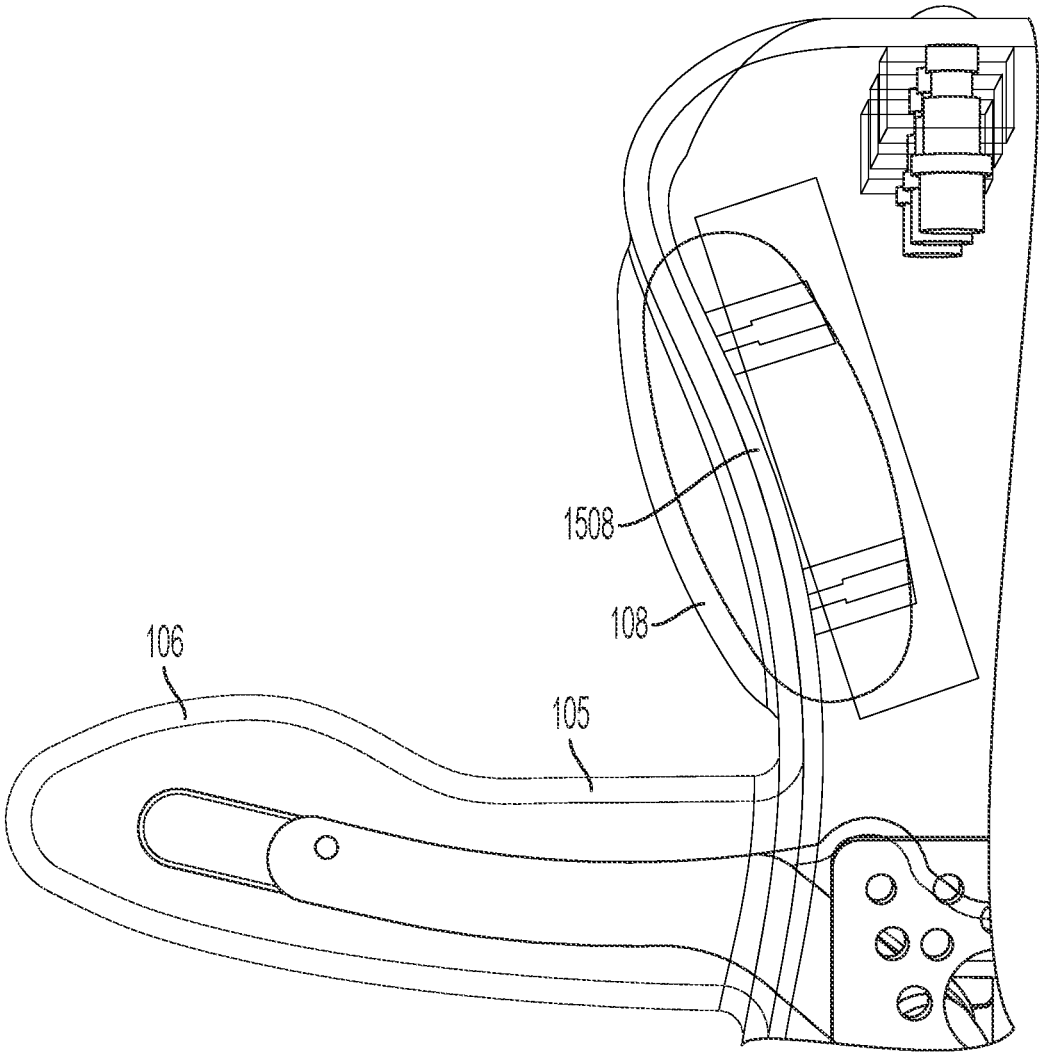
FIG. 15 shows details of a vibration mechanism of disclosed embodiments.

FIG. 15 shows details of a vibration mechanism of disclosed embodiments. In embodiments, a vibration capsule 1508 is installed inside the device proximal to the clitoral massage surface 108 such that it can impart vibrations to the user when the clitoral massage surface 108 is in contact with the body of a user. The vibration capsule includes a vibration motor inside of it to impart the vibrations. In some embodiments, the vibration surface may extend outward from the shaft-side surface such that it can reach the user's clitoris more easily when the device is in use.

Figure 16A:
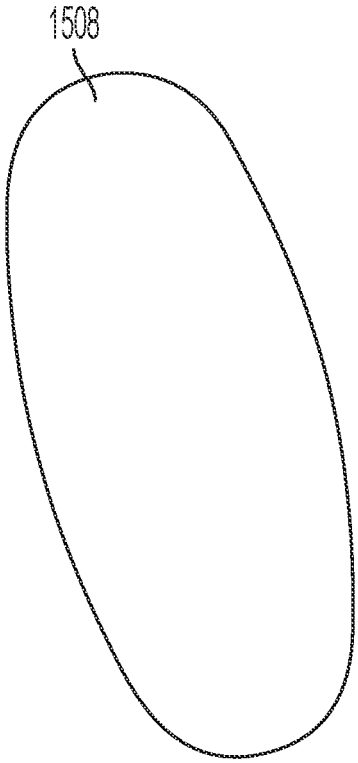
FIG. 16A-16C show details of a vibration capsule of disclosed embodiments.
Figure 16B:
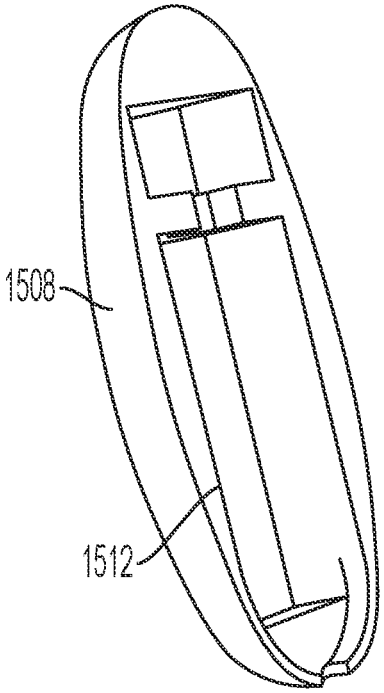
Figure 16C:
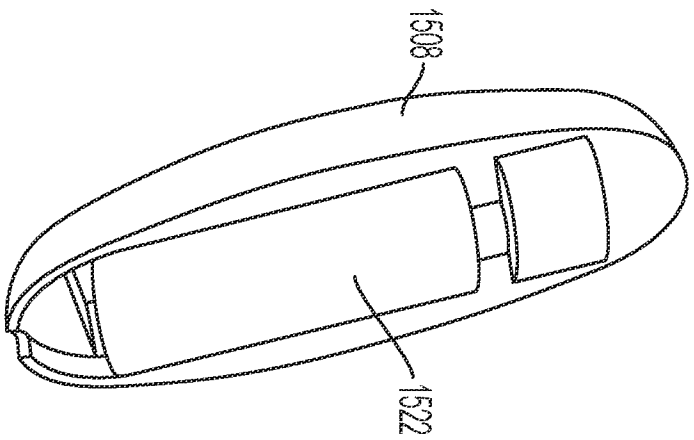

FIG. 16A-16C show details of a vibration capsule of disclosed embodiments. FIG. 16A shows a perspective view of a vibration capsule 1508. FIG. 16B shows a cut-away view of vibration capsule 1508, indicating motor cavity 1512 that is adapted to fit a vibration motor. FIG. 16C shows a cut-away view of a vibration capsule including a vibrator motor 1522. Vibration motor 1522 may be similar to vibration motor 1114. In some embodiments, the vibrator may be replaced with a pulsator, gyrator, or other suitable massage device.

As can now be appreciated, disclosed embodiments provide a novel stimulation device. The device includes a G-spot stimulator, a clitoral stimulator, and an enclosure including two concave sides, and a convex opposing surface that supports a rocker mode of operation. It should be recognized that the body can be used with any type of massage device, and those shown as examples.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A sexual stimulation device, comprising:
an enclosure;
wherein the enclosure comprises:
a shaft-side surface;
a first concave side surface;
a second concave side surface;
a shaft protruding from the shaft-side surface of the enclosure;
a barrel cam;
a pivot beam, the pivot beam comprising a pin at a first end of the pivot beam, the pin engaging within a groove of the barrel cam;
a tip, the tip rotatably attached to a second end of the pivot beam.
a first side bracket; and
a second side bracket, wherein the first side bracket and second side bracket are rotatably attached to the tip.

2. The device of claim 1, further comprising a convex opposing surface that opposes the shaft-side surface.

3. The device of claim 2, wherein the shaft further comprises a moveable tip.

4. The device of claim 3, wherein the moveable tip is rotatably attached to the shaft.

5. The device of claim 1, wherein the shaft-side surface further includes a vibration surface disposed thereon.

6. The device of claim 1, wherein the shaft includes a silicone exterior surface.

7. A sexual stimulation device, comprising:
an enclosure;
wherein the enclosure comprises:
a shaft-side surface;
a first concave side surface;
a second concave side surface;
a shaft protruding from the shaft-side surface of the enclosure;
a shaft motor disposed in an interior of the enclosure;

a barrel cam mechanically coupled to the shaft motor, wherein the shaft is mechanically coupled to the barrel cam;

a pivot beam, the pivot beam comprising a pin at a first end of the pivot beam, the pin engaging within a groove of the barrel cam;

a tip, the tip rotatably attached to a second end of the pivot beam.

a first side bracket; and a second side bracket, wherein the first side bracket and second side bracket are rotatably attached to the tip.

8. The device of claim 7, wherein the first side bracket and second side bracket each comprise:

a first portion;

a second portion oriented at an angle to the first portion;

a first opening located between the first portion and the second portion;

a second opening located at a distal end of the second portion; and a concave cutout formed within the first portion.

9. The device of claim 8, wherein the pivot beam has a first point of rotation, the first side bracket and second side bracket have a second point of rotation, and wherein the first point of rotation is different than the second point of rotation.

10. The device of claim 8, wherein the shaft-side surface further includes a vibration surface disposed thereon.

11. The device of claim 10, further comprising:

a processor;

a memory coupled to the processor, the memory containing instructions, that when executed by the processor, cause the device to:

operate the shaft motor to cause the tip of the shaft to periodically deflect with respect to a longitudinal axis of the pivot beam.

12. The device of claim 11, further comprising:

a vibration motor coupled to the vibration surface, and wherein the memory further contains instructions, that when executed by the processor, cause the device to operate the vibration motor.

13. The device of claim 12, further comprising a wireless communication interface coupled to the processor.

14. The device of claim 13, further comprising a non-volatile memory, and wherein the non-volatile memory is configured and disposed to store one or more user preference settings.

15. The device of claim 13, wherein the wireless communication interface comprises a short-range wireless interface.

16. The device of claim 7, further comprising a convex opposing surface that opposes the shaft-side surface.

17. The device of claim 7, wherein the shaft includes a silicone exterior surface.

18. The device of claim 7, further comprising a removable battery.

19. The device of claim 18, wherein the removable battery is a rechargeable battery.

* * * * *